United States Patent [19]

Samuel et al.

[11] Patent Number: 4,631,845

[45] Date of Patent: Dec. 30, 1986

[54] LUGGAGE TAG

[75] Inventors: Robert A. Samuel, Snohomish; Lauren W. Huseby, Lynnwood; Erick W. Weitkamp, Mukilteo; Christopher A. Wiklof, Everett, all of Wash.

[73] Assignee: Intermec Corporation, Lynnwood, Wash.

[21] Appl. No.: 735,112

[22] Filed: May 17, 1985

[51] Int. Cl.[4] ..... A44C 3/00

[52] U.S. Cl. ..... 40/2 R; 40/6

[58] Field of Search ..... 40/2 R, 6, 316, 21 R, 40/20 R

[56] References Cited

U.S. PATENT DOCUMENTS

| | | | |
|---|---|---|---|
| 976,073 | 11/1910 | Harrod | 40/2 R |
| 1,337,722 | 4/1920 | Porter | 40/21 |
| 2,098,164 | 11/1937 | Rice | 40/21 |
| 3,130,509 | 4/1964 | Brooks | 40/21 |
| 3,228,129 | 1/1966 | Gwinn et al. | 40/21 |
| 3,963,124 | 6/1976 | Banks | 40/2 R |
| 3,994,085 | 11/1976 | Groselak et al. | 40/21 |
| 4,312,523 | 1/1982 | Haines | 283/18 |
| 4,329,191 | 5/1982 | Barber | 156/64 |
| 4,432,830 | 2/1984 | Jue | 156/384 |

*Primary Examiner*—Robert P. Swiatek
*Assistant Examiner*—Cary E. Stone
*Attorney, Agent, or Firm*—Christensen, O'Connor, Johnson & Kindness

[57] ABSTRACT

Provided is a luggage tag (10) that is attachable to the handle (32) of a piece of luggage and is comprised of an elongate strip of flexible material. A longitudinal fold line (18) is scored into the tag and extends from one end (14) to terminate at a detachable ticket (22) that is integrally formed in the center of the tag and extends from the terminus of the fold line to the other end of the tag. Tongues are formed in the tag on each side of the detachable ticket. The detachable ticket and tongues are configured and arranged so that removal of the ticket allows passage of the handle between the tongues. The tag is then folded along the fold line and the tongues are joined to enclose the handle, thereby securing the tag to the handle.

5 Claims, 7 Drawing Figures

Fig. 2.
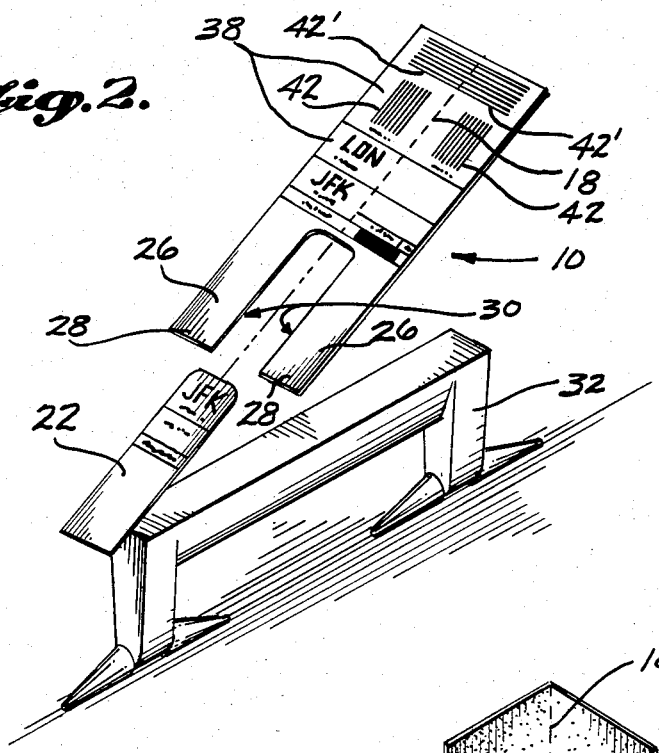
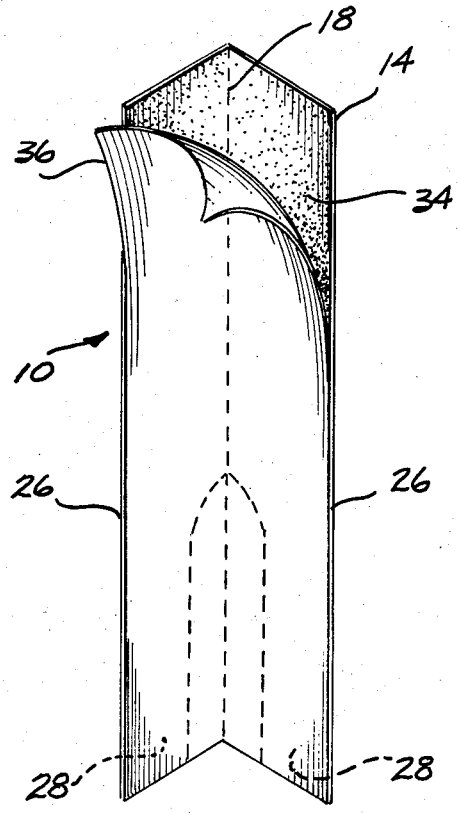
Fig. 5.

LUGGAGE TAG

BACKGROUND OF THE INVENTION

This invention relates to luggage tags that are readily attachable to the handles of individual pieces of luggage.

In order to control the transportation of luggage, identifying labels or tags are commonly attached to each individual piece of luggage. One method of attaching the tags is to loop the tag around the luggage handle and then fasten the tag ends together, usually with an adhesive. U.S. Patents issued to Rice (U.S. Pat. No. 2,098,164), Porter (U.S. Pat. No. 1,337,722), and Groselack et al. (U.S. Pat. No. 3,994,085) disclose luggage tags that utilize this method of attachment. Another method of attachment includes fixing a flexible cord to the tag, the cord then being suitably secured to the handle.

Some form of indicia are typically printed on the tags so that the itinerary of the luggage can be ascertained by those responsible for its transport. Furthermore, luggage tags commonly have detachable claim checks or tickets with numbers printed on them that correspond to likewise printed numbers on the main portion of the tag itself. As is commonly known, the luggage owner retains this ticket until the piece of luggage is claimed at the end of its journey.

This invention presents a new luggage tag configuration for quick and easy attachment to the handle of a piece of luggage. For simplified production, the indicia may be printed on only one side of the tag in a single pass. However, when the tag is properly attached to the handle, the printed indicia are conveniently displayed on both sides of the attached tag.

SUMMARY OF THE INVENTION

The present invention provides a luggage tag that is attachable to the handle of a piece of luggage and is comprised of an elongate strip of flexible material that has first and second ends, a front, and a back. A longitudinal fold line is scored into the tag and extends from the first end of the tag to terminate at a point between the first and second ends. A detachable ticket is integrally formed in the center of the tag and extends from the terminus of the fold line to the second end of the tag. Tongues are formed in the tag on each side of the detachable ticket. The tongues and detachable ticket are configured and arranged so that removal of the ticket allows passage of the handle between the tongues. The tag is then folded along the fold line and the tongues are joined to enclose the handle, thereby securing the tag to the handle.

In the preferred embodiment, the tongues are joined by an adhesive.

As another aspect of this invention, indicia are printed on the front of the tag on each side of the fold line. Thus, when the tag is folded, the indicia will be displayed on both sides of the tag.

BRIEF DESCRIPTION OF THE DRAWINGS

The invention can best be understood by reference to the following portion of the specification, taken in conjunction with the accompanying drawings in which:

FIGS. 2–4 are isometric views of the luggage tag of FIG. 1 showing the preferred method of attaching the tag to a handle;

DETAILED DESCRIPTION OF THE INVENTION

Figure 1:
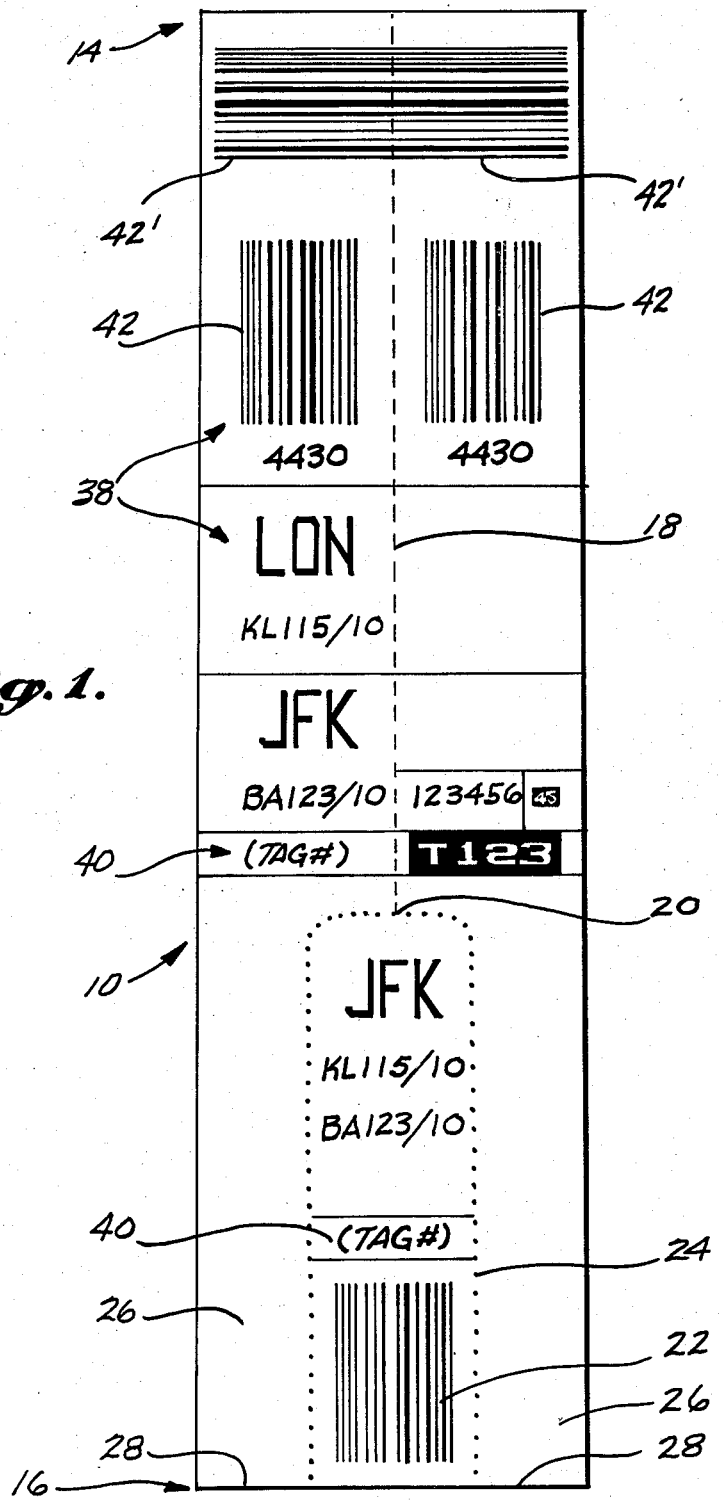
FIG. 1 is a plan view of the front of the luggage tag made in accordance with this invention.

Referring to FIG. 1, illustrated is a luggage tag 10 made in accordance with this invention. Luggage tag 10 is comprised of an elongate strip of flexible material having a first end 14 and a second end 16. A fold line 18 is scored along the longitudinal centerline of the tag 10 and extends from the first end 14 to a point 20 that is located away from the second end by a distance of approximately one-third of the length of the tag. As will be understood upon reading this description, the position of point 20 along the centerline of the tag can vary considerably without affecting the nature of this invention.

An elongate, detachable ticket 22 is integrally formed in the center portion of the tag 10. The detachable ticket 22 extends from the terminus of the fold line 18 at point 20 to the second end 16 of the tag. The ticket 22 is defined by perforations 24 formed in tag 10 along the periphery of the ticket.

The formation of the detachable ticket 22 in the tag 10 creates tongues 26 that extend along both sides of ticket 22; the free ends 28 of the tongues corresponding to the econd end 16 of the tag. Alternatively, detachable ticket 22 may be attached to the tag 10 at a location other than between tongues 26. For example, ticket 22 may be detachably secured to the first end 14 of the tag 10.

Figure 4:
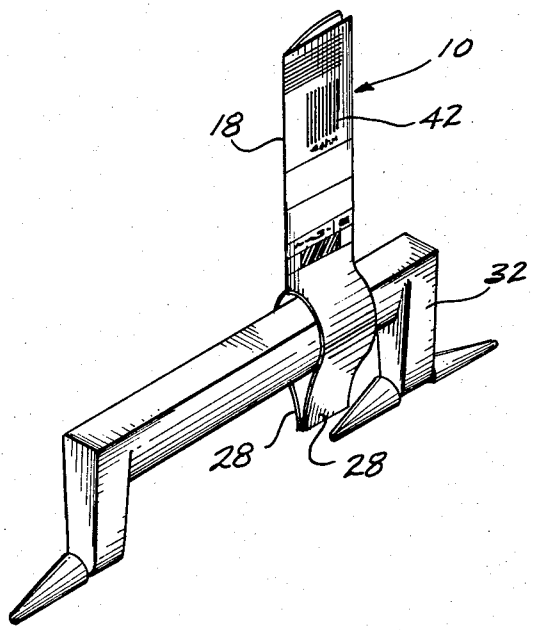

As shown in FIGS. 2, 3, and 4, in the preferred embodiment, when detachable ticket 22 is removed from the main body of the tag, a slit 30 is created. Slit 30 facilitates attaching the luggage tag to the handle 32 of a piece of luggage. Specifically, in order to attach tag 10 to handle 32, the tag is directed toward the handle so that the handle is allowed to pass into the slit 30 between the tongues 26. The tag 10 is folded long its longitudinal fold line 18 and then the free ends 28 of the tongues 26 are joined together in back-to-back fashion to enclose the handle, thereby securing the tag to the handle.

Figure 5:
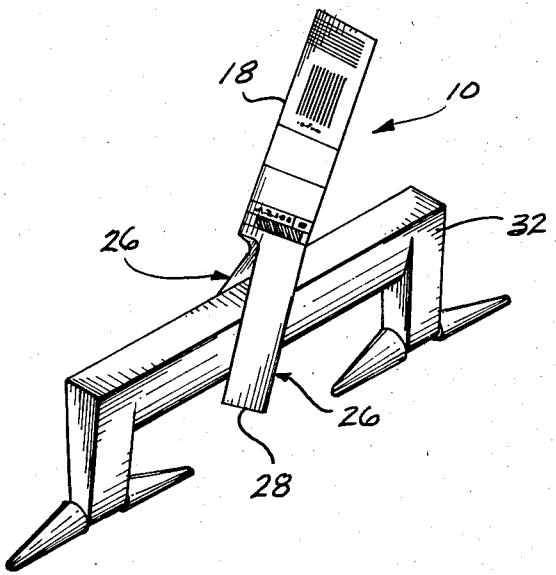
FIG. 5 is an isometric view of the back of the luggage tag made in accordance with this invention.

FIG. 5, which illustrates the back of luggage tag 10, shows that a pressure-sensitive adhesive 34 is applied to the entire back surface of the tag 10. In the preferred embodiment, it is this adhesive 34 that provides the method of joining the free ends 28 of the tongues together and helps to ensure that tag 10 remains folded after attachment. A removable backing 36 covers the adhesive 34. The backing 36 consists of a paper strip provided with a silicon release agent for easy removal of the strip from the adhesive that is attached to the back of tag 10.

Adhesive 34 can be pressure-sensitive material exhibiting cohesive properties. Thus, the back of tag 10 will only stick to itself when folded. If such material is used, there is no need for backing 36.

It is pointed out that adhesive 34 could be applied to a smaller area than that shown in FIG. 5. For example, adhesive 34 could be applied to only the back of one or both tongues 26. This application would be adequate to secure the tag to the handle. Thus, the remainder of the tag, although folded, will not be stuck to itself.

Figure 7:
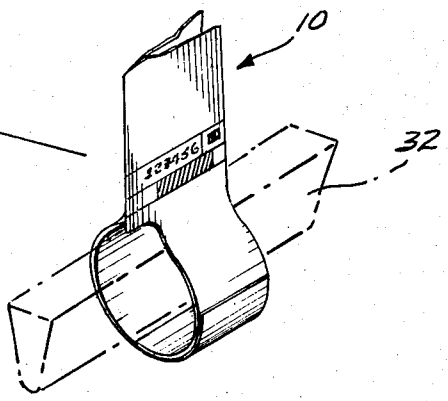
FIGS. 6 and 7 are isometric views of a portion of the tag made in accordance with this invention showing an alternative method of attachment to the handle.
Figure 6:
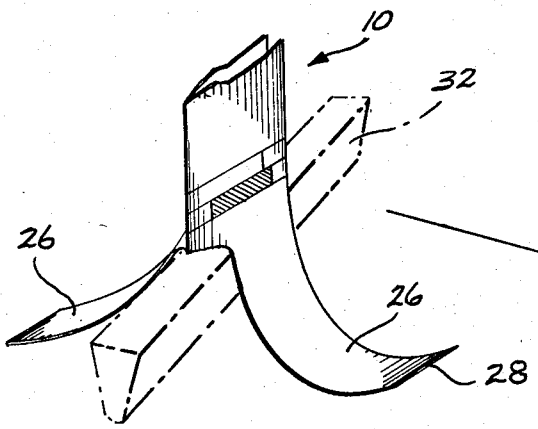

FIGS. 6 and 7 illustrate an alternative method of attaching the tag 10 to the handle 32. Specifically, after handle 32 is positioned between tongues 26, the tongues are wrapped one over the other to enclose the handle. An adhesive, suitably applied as described earlier, secures the tongues together.

With reference to FIGS. 1 and 2, indicia 38 are printed on the front of tag 10. Included in this indicia is a tag number 40 that is printed on both the main body of the tag and the detachable ticket 22. Thus, when the detachable ticket 22 is removed from the tag 10, it can be used as a conventional claim ticket that is retained by the owner of the luggage.

In the preferred embodiment, machine-readable indicia, such as the bar code records 42 shown, are also printed on the front of tag 10. Preferably, the bar code records 42 are printed in duplicate form on each side of the fold line 18 of the tag so that when the tag is attached to a handle, as shown in FIG. 4, the bar code record 42 will be readily available for use with conventional scanning devices on either side of the tag. Hence, after attachment, the folded tag has no front or back.

Additional bar code records 42' are printed on the front of the tag 10 on both sides of score line 18 and are orthogonally disposed with respect to bar code records 42. Bar code records 42' are identical to bar code records 42 and are orthogonally disposed so that a scanning device can move either laterally or longitudinally along the tag and be able to read the same record either way.

Due to the above-described structure and method of attachment of the tag formed in accordance with this invention, all indicia may be printed on one side of the tag. Thus, the tag can be quickly produced by any suitable single-pass printing method.

The preferred way of producing the tag 10 includes the use of a thermal printer such as that manufactured by INTERMEC Corporation of Lynnwood, Washington, Model No. 8625A. Such a printer is capable of printing the required indicia (in both human-, or machine-readably form) upon an elongate strip of thermal print stock that is preformed into a succession of tags having the above-described structure and are carried by a continuous backing strip. The tags are then individually dispensed from the printer. Preferably, the backing strip is automatically stripped from the tag and wound around a take-up reel within the printer. The details of this printing and stripping operation are described in U.S. Pat. No. 4,332,830 issued to C. T. Jue and entitled "Label Printer Having Selectable Label Stock Paths."

Alternatively, other techniques may be employed for printing the indicia 38 on tag 10. These techniques can include laser printers, ink jet printers, or mechanical impact-type printers.

Preferably, printing of the indicia 38 on the front of tag 10 takes place at the time the luggage is checked and travel information is entered into a computer which correspondingly controls the printer. Relevant portions of the travel information (e.g., intermediate and final destinations) can then be instantaneously printed upon each tag.

Alternatively, the tags 10 can have indicia 38 preprinted upon them which represent a variety of travel routes, etc. These tags can be stored at the point of check-in for use at that time.

While the invention has been described with reference to a preferred embodiment, it is to be clearly understood by those skilled in the art that the invention is not limited thereto. Rather, the scope of the invention is to be interpreted only in conjunction with the appended claims.

The embodiments of the invention in which an exclusive property or privilege is claimed are defined as follows:

1. A luggage tag attachable to the handle of a piece of luggage comprising:

(a) an elongate strip of flexible material having a first end, a second end, a front, and a back;

(b) a longitudinal fold line scored into the tag and extending from the first end of the tag to terminate at a point between the first end and the second end, the tag being foldable about the fold line;

(c) a detachable ticket integrally formed in the center of the tag and extending from the terminus of the fold line to the second end of the tag;

(d) tongues formed in the tag on each side of the detachable ticket, the detachable ticket and tongues being configured and arranged so that removal of the ticket from the tag allows passage of the handle between the tongues; and (e) joining means for joining one tongue to the other to enclose the handle thereby securing the tag to the handle.

2. The tag of claim 1 further comprising indicia printed on the front of the strip, the indicia being printed on each side of the fold line.

3. The tag of claim 2 wherein at least one portion of the indicia is machine readable.

4. The tag of claim 1 wherein the joining means is an adhesive applied to at least one tongue.

5. The tag of claim 1 wherein the joining means is an adhesive applied to the back of the tag on at least one side of the fold line.

* * * * *